United States Patent [19]

Haberstroh et al.

[11] 4,276,736

[45] Jul. 7, 1981

[54] PROCESS AND APPARATUS FOR DOING UP SHEET MATERIAL WITH LABEL TAPES

[75] Inventors: Markus Haberstroh, Planegg; Herbert Bernardi, Haag, both of Fed. Rep. of Germany

[73] Assignee: GAO Gesellschaft für Automation und Organisation mbH, Munich, Fed. Rep. of Germany

[21] Appl. No.: 60,140

[22] Filed: Jul. 24, 1979

[30] Foreign Application Priority Data

Aug. 11, 1978 [DE] Fed. Rep. of Germany ..... 2835308

[51] Int. Cl.[3] ..... B65B 13/06; B65B 27/08

[52] U.S. Cl. ..... 53/399; 53/447; 53/540; 53/586; 53/590

[58] Field of Search ..... 53/399, 436, 447, 528, 53/540, 586, 590; 83/199

[56] References Cited

U.S. PATENT DOCUMENTS

| | | | |
|---|---|---|---|
| 1,190,848 | 7/1916 | Batdorf | 53/528 |
| 3,416,286 | 12/1968 | Ciccone | 53/586 X |
| 3,991,542 | 11/1976 | White et al. | 53/586 |
| 4,063,481 | 12/1977 | Raudys et al. | 83/199 |
| 4,111,116 | 9/1978 | Ito et al. | 53/586 X |

*Primary Examiner*—Horace M. Culver

*Attorney, Agent, or Firm*—Andrus, Sceales, Starke & Sawall

[57] ABSTRACT

In a process for forming stacks of pieces of sheet material such as banknotes from an unbroken train of such sheets, the stacking of the sheets and the placing of label tapes round them takes place at one at the same position.

24 Claims, 23 Drawing Figures

43
45
25
8
21
40
41
55

40
21
43
46
42b
45
44
41
42a
8
55

8
25
40
55
46
21
33
32
34
13
37
38
8
36
34

PROCESS AND APPARATUS FOR DOING UP SHEET MATERIAL WITH LABEL TAPES

BACKGROUND OF THE INVENTION (i) Field of the Invention

The present invention relates to a process for labelling thin sheet material, more specially banknotes, using label tapes in the case of which in each case a desired number of single sheets in a train are stacked and the stack is labelled with the label tape. The invention is furthermore in respect of an apparatus for effecting the process.

(ii) The Prior Art

More specially in connection with automatic banknote sorting systems, a number of forms of apparatus have been designed in the case of which those banknotes, which at the end of the sorting process are seen to be good for further use, are stacked again in small stacks and done up with a label tape.

For example in the British Pat. No. 1,305,394 there is an account of a stacking and label taping system.

The general teaching of this old system is that the banknotes taken from the transport system by a stacker drum are placed on a stacking table placed under the stacker drum and, once the desired number of banknotes has been stacked, the stack is moved on to a second label taping table on which, lastly, the label tape is placed on it.

In the first stage of each labelling operation, a label tape, after being cut to the necessary length, is positioned at the middle of the taping table and as soon as this table with the label tape is moved under the stacking table, the stack is pushed with the help of driving parts from the stacking table on to the taping or labelling table. As part of the further operation, the label tape is placed by gripping parts, located at the sides of the table and moving towards the stack at its two sides, around the two longsides of the stack. Then the label tape, having a coating of hot-sealing material, has its two ends joined one on top of the other by the sealing operation. The stack, complete with its label tape, then lastly goes to a position where it is moved on to an output transport system.

In addition to the great amount of space needed by it, the design of this earlier system has shortcomings because it is complex and, for this reason, not free of trouble on operation.

With respect to running troubles there is, more specially, the shortcoming in this respect that the stack has to be moved a number of times while still untaped. Because of this motion, in which respect the pushing down of the stack from the stacking table on to the taping table is to be noted as being more specially the cause of trouble—the banknotes are in all cases moved more or less out of line within the stack—so that putting a label tape round the stack in position is made hard or may even not be possible, particularly at high speeds of taping.

A further shortcoming is that the forming of a stack with the true, desired shape does not in all cases take place with the old apparatus. It is, however, more specially, the forming of a trued-up stack which is an important condition for producing stacks with lined-up edges and on which the label tape may be fixed tightly. Although different banknote stacks all having the same number of notes may be very different in height, dependent on the quality of the notes, in the old machine no measures are taken for overcoming unevenness of stack size. Banknotes in stacks of different, uncontrolled height are, for this reason, not able to be taped with label tapes, or if taping is possible, the quality does not come up to the desired level. Furthermore the position at which the label tape is seated, in the case of the old apparatus, is greatly dependent on the condition of the banknotes being processed. Furthermore use with label tapes in a form cut to size earlier is the cause of shortcomings, because, namely, a label tape separating unit is necessary, which is likely to have trouble on running, and a somewhat complex positioning operation is necessary for placing the separated label tapes on the taping table.

SHORT OVERVIEW OF THE INVENTION

One purpose of the present invention is that of designing a stacking and taping unit needing little space and which puts an end to the shortcomings noted. A further purpose of the invention is that of designing such a system which, as the last unit of a fully automatic high-speed sorting unit, may be used for forming a stack of banknotes with all the sides of the stack in line, at a high speed, so that the banknotes may be certainly and tightly taped with the label tapes, the banknotes coming to the unit in a train one after the other at a high speed.

The invention is responsible for a great number of useful effects: For example, because of the fact that the banknotes are stacked within the label taping unit, the stack is trued up and, at one and the same position, is done up with a label tape, there is on the one hand a decrease in the size of the apparatus and, on the other hand, running troubles are greatly decreased, because there is no transport of untaped stacks.

Furthermore there is the important useful effect that the apparatus may be used for a certain taping up of any banknotes which, under some conditions, are not stacked in the desired condition, with the outcome, because of this, that there is no stopping of the high-speed sorting operation.

Furthermore steps are taken to see that the label tapes are fixedly seated on the stacks without being dependent on the quality of the banknotes, that is to say on the density of the stack or its height.

Because of the special design of the welding or hot-sealing unit, it is lastly possible to make certain that there is in all cases a welding together of the ends of the label tapes over great areas while still keeping to a short welding time, with the outcome of a strong, long-lasting fixing of the label tape on the stack.

LIST OF FIGURES

Further measures and useful effects of the invention will be seen from the account now to be given of one working example of the invention.

FIGS. 3*a* to 3*m* are views of the single stages of operation on the placing of a label tape in position.

Figures 4A, 4B, 4C:
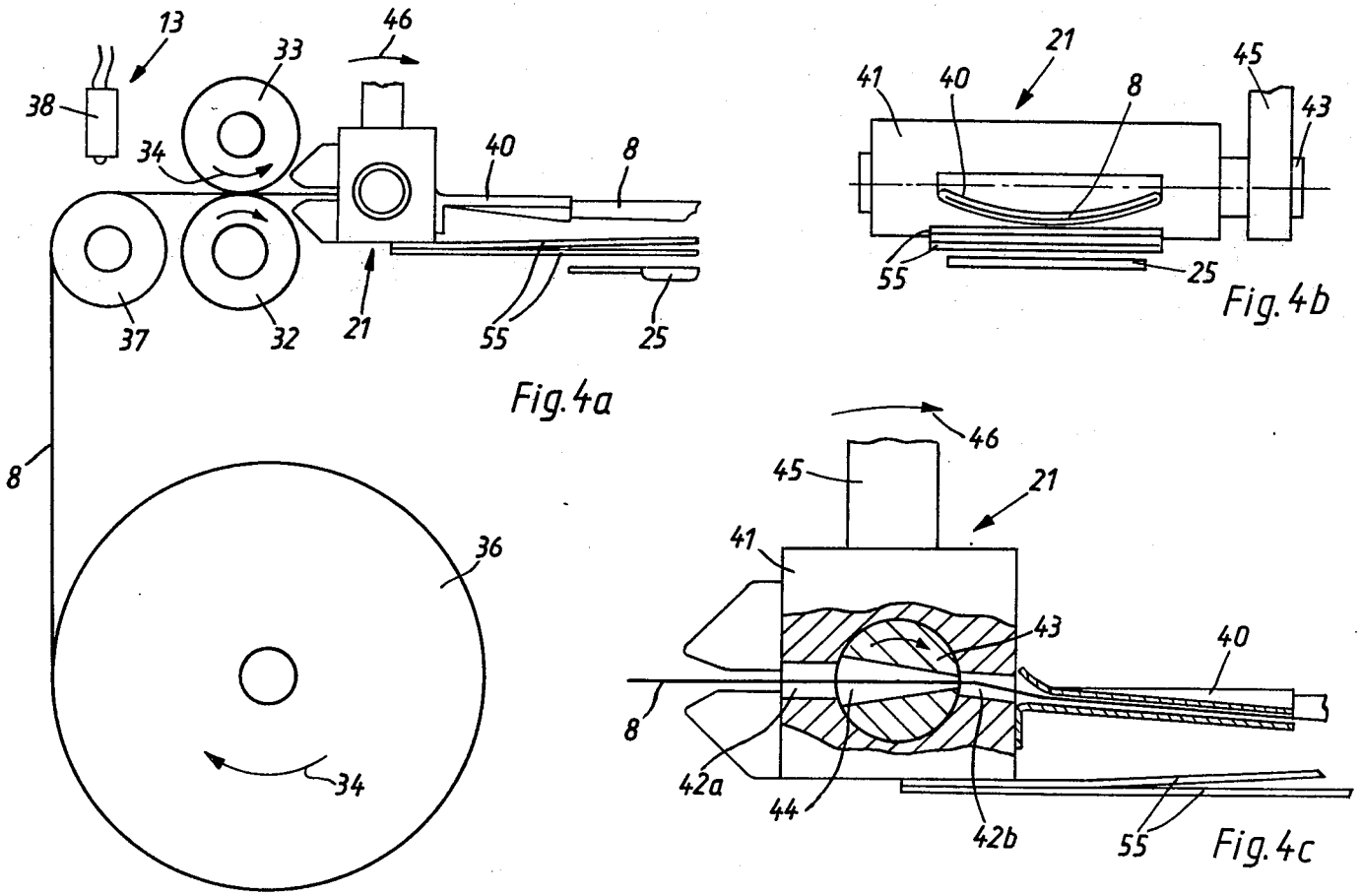

FIGS. 4*a* to 4*c* are views of the label tape input unit.

Figure 5:
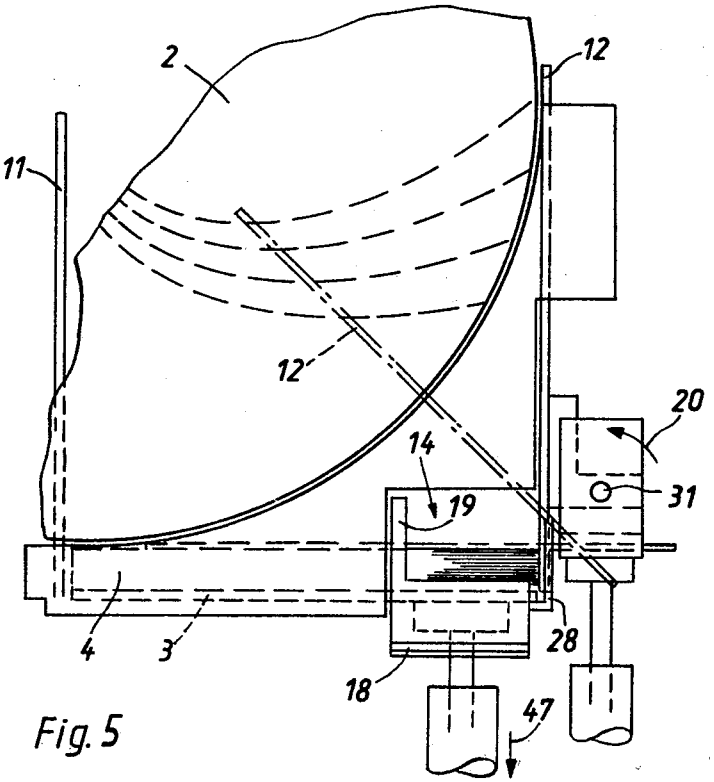

FIG. 5 is a view of the stacking and taping unit.

Figure 6:
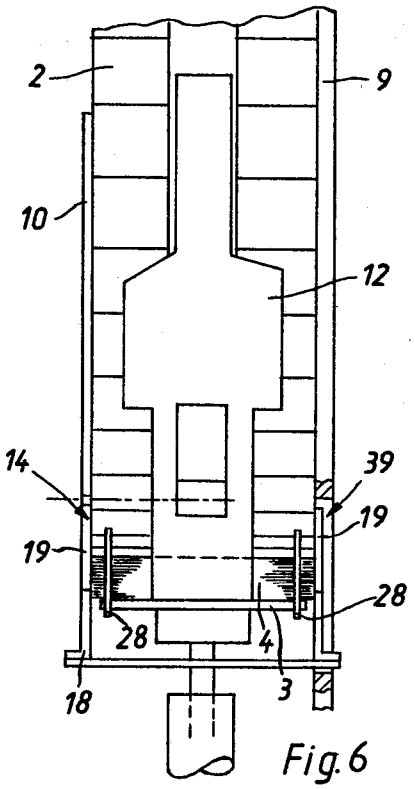

FIG. 6 is a side-view of the stacking and taping unit.

Figure 7A:
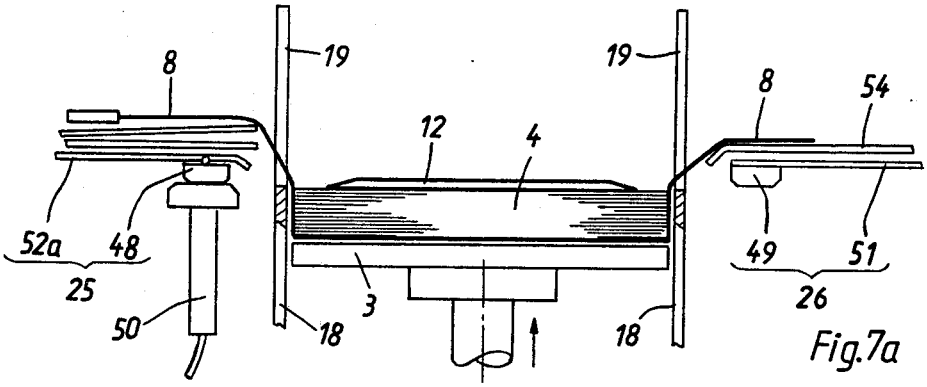
Figure 7:
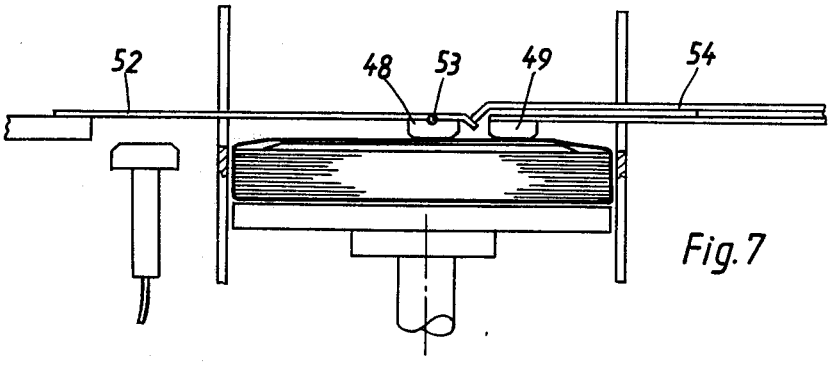
Figure 7C:
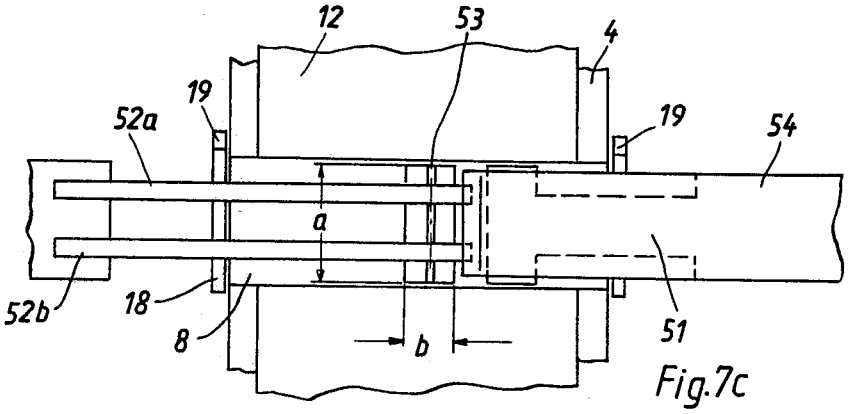

FIGS. 7*a* to 7*c* are detailed views of the welding or hot sealing operation.

DETAILED ACCOUNT OF FORMS OF THE INVENTION

To make clear the general order of functions (see FIGS. 1 to 3), an account will now be given of the apparatus for stacking and doing up banknotes with label tapes.

As will be clear from the figures, the banknotes are moved by way of a transport system 1 on to what is generally named a stacker drum 2, and of which an account is given, for example, in the German Offenlegungsschrift specification No. 2,555,307. On being moved into the spiral takeup pockets 5, the banknotes are braked, forced outwards through a stripping part 11 which is moved in an upright direction into the stacker drum and the notes are then lastly placed on a stacking table 3, which is under the stacker drum.

Even on being dropped, steps are taken to see that the separate banknotes are placed in line one on top of the other for forming a parcel-like stack 4. For making certain that the stack sides are in line, all round, as is to be seen in FIGS. 1 and 2, with respect to details, use is made at the long-edges of the support wall 9 and of a sheet metal former 10 and, at the end faces, of the stripping part 11 and a stack weighting plate 12 which at this stage is in an upright position, and of which an account will be given later.

Figure 2:
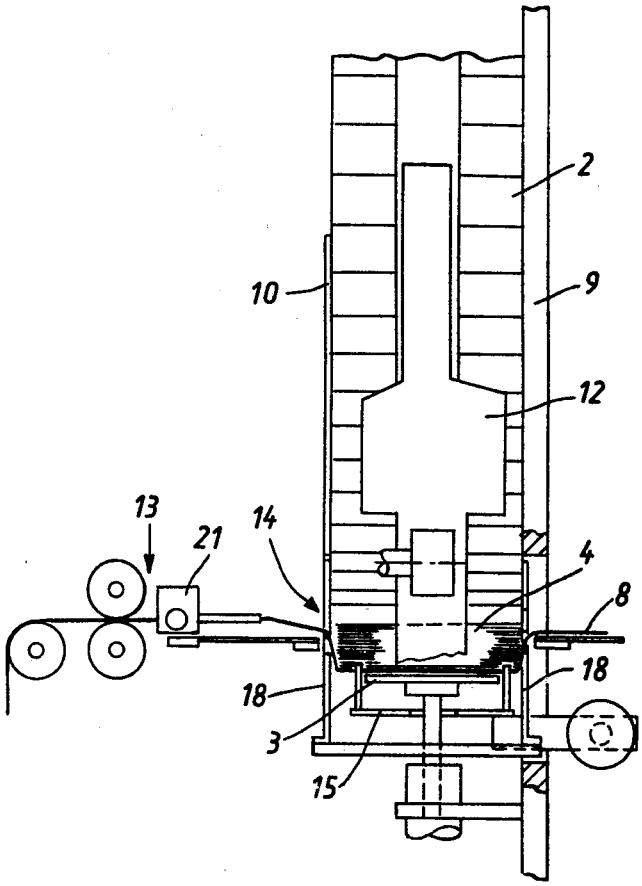
FIG. 2 is a side-view of the apparatus to be seen in FIG. 1.

Before the dropping down of the first banknote, see FIG. 2, by way of an input unit 13, the label tape 8 is pushed through a cutout 14 in the sheet metal former 10 over on to the stack table 3, so that after the dropping down of the banknotes for making up the parcel or stack, the label tape is in position between the stack table 3 and the stack itself 4.

When the number of banknotes needed for a parcel has been run into the stacker drum 2, something being sensed by a photo-electric sensing system 7 in the transport system, after changing over a mechanical switch 6 or direction controller, the next train of banknotes is run on to a second stacking and taping unit (not viewed) which is the same in design in all details. By the use of two stacking and taping units, worked in turn one after the other, it is possible to make certain that even in the case of very high transport speeds and an unbroken banknote train, there is no cut off of motion of banknotes through the system.

After the changing over of the switch 6, the taping operation itself and of which a detailed account is to be given, is started, this being effected as well by a signal from the photo-electric system 7 although this is timed to take place somewhat later.

Figure 1:
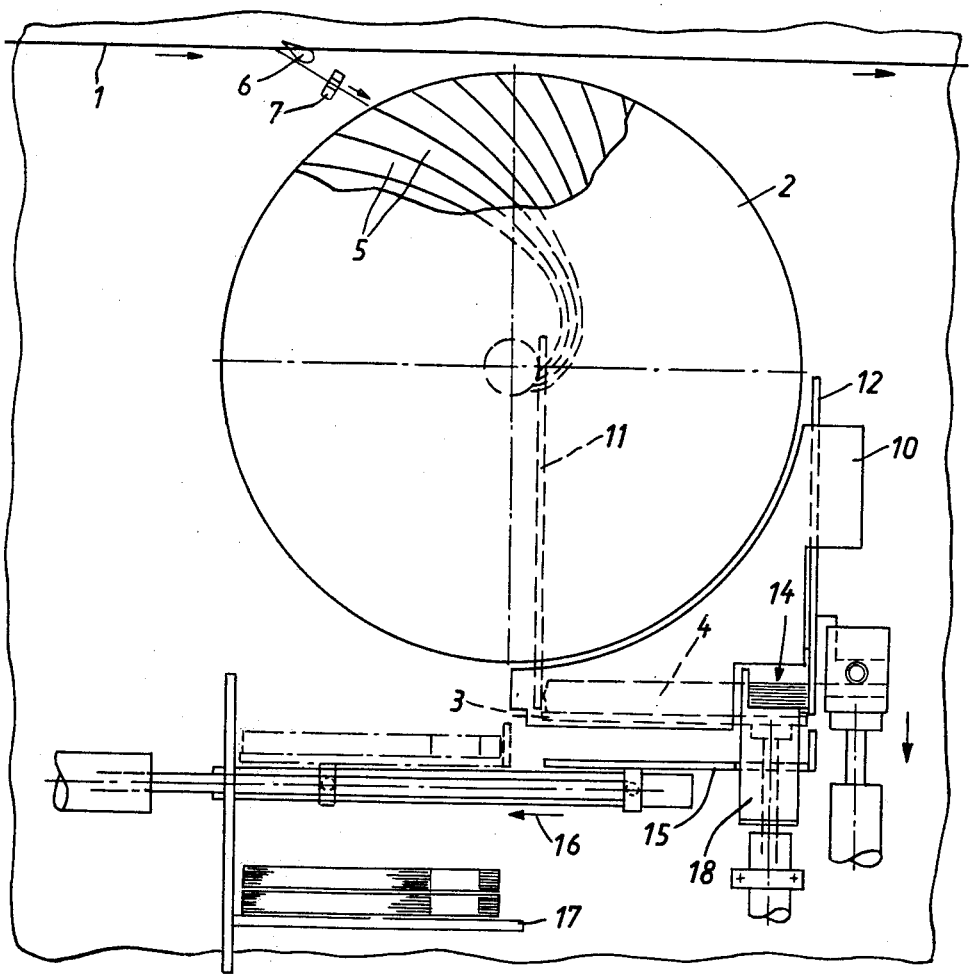
FIG. 1 is a front-view of the apparatus.

At the end of the taping operation, the taped parcel is moved by way of a second table 15, placed under the stacking and taping table 3, see FIG. 1, in the direction of arrow 16 on to a takeup table 17, from which then a desired number of taped parcels may be pushed out of the apparatus and lastly taken by hand.

As a general point, it is to be noted that the taping operation has to have come to an end before the number, needed for a parcel, of banknotes has got to the stacking and taping unit, which is used at the same time. If, for example, it is a question of 100 banknotes having to be taped up in each case and if the banknote input rate in each second is 40 without any cut off in the train of banknotes, the taping operation, together with the dropping of the taped parcel, and the steps for getting ready for the later taping operation have to be completed in less than 2½ seconds.

An account will now be given of the steps of the operation, to be undertaken at this time, for taping, use being made for this purpose of FIGS. 3*a* to 3*m*, in which, in each case in a side and a front-view, there is a view of the parts of the apparatus as needed for making its operation clear.

At the start of each taping operation the tape 8 is moved by an input unit 13 (see FIG. 2) over the taping table 3. As will be clear from FIG. 3*a*, the tape, after this first working step, is not only on the table 3, but furthermore on the sheet metal guides 18, placed on two sides of the table, and on the pushers 25 and 26, as well placed to the two sides of the table and whose function will be made clear presently.

Figure 3A:
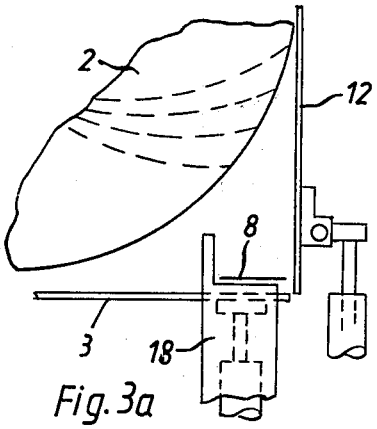
Figure 3B:
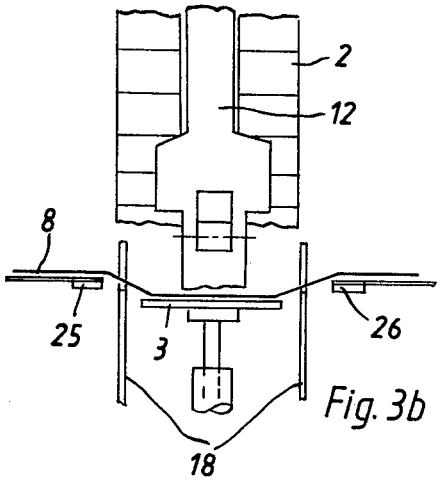
Figure 3C:
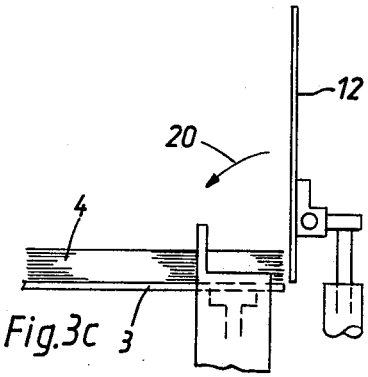
Figure 3D:
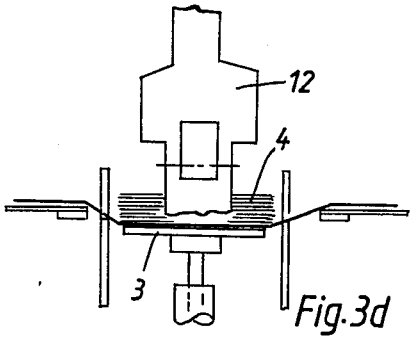
Figure 3E:
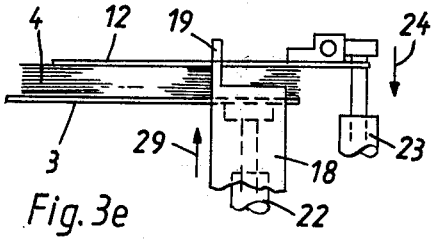
Figure 3F:
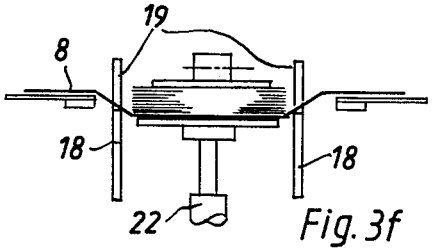

When the banknotes are being transported by the stacker drum 2 on to the taping table 3, the label tape 8, as will be seen in FIG. 3*c*, is between the stack 4 and the table 3. If a starting signal is now produced for the taping operation, the weighting plate 12 is turned in the direction of the arrow 20 on to the formed stack 4, so that the stack is forced against the taping table 3 which is joined with an air-powered cylinder 22 and, for this reason, is "air-cushioned". As will be clear from FIG. 3*e*, the stack 4 in this stage is so positioned by the two finger-like tailpieces 19 of the sheet metal guides 18 on its two sides that it is able to be pulled into position between the sheet metal parts strongly without any chance of being stopped when a later downward motion takes place, of which an account will be given presently. After the label tape 8 has been cut with the cutting unit 21 (see FIG. 2) to the desired length, the weighting plate 12 is moved downwards with the help of the air cylinder 22 against the force of the air cylinder 22 in the direction of the arrow 24 (see FIG. 3*c*). Because the opposite force of the taping table 3 in the direction of the arrow 29 is produced by the air-powered cylinder 22, the force pushing the stack together and, for this reason, lastly the pulling effect of the tape on the stack may be very simply changed by adjustment of the pressure of the compressed air going to the cylinder.

Figure 3G:
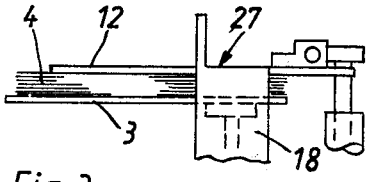
Figure 3H:
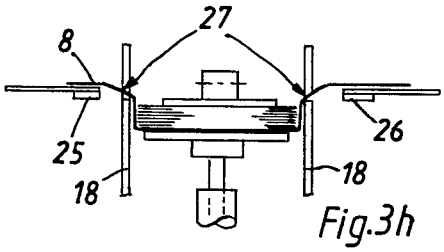

At the time of moving down of the weighting plate 12, the tape, fixed in position by the weighted stack, is pulled over the two sheet metal parts 18 placed to the two sides of the table 3 and, as this is done, placed tightly over the two long-sides of the stack (see FIG. 3*g*). For stopping any slipping out of position of the label tape 8 on downward motion, the taping table has a rough surface, for a better gripping effect, at the position where the label tapes are positioned. As will be seen from FIG. 3*g*, the stack is moved together with the label tape 8 downwards to such a degree that the top side of the weighting plate 12 is in the plane of motion of the pushers 25 and 26 placed on the right hand and left hand sides of the taping table 3. For this reason, the pushers 25 and 26, used for putting round and weld-joining of the ends of the label tape, are guided, in each case, over the top edges 27 of the side sheet metal parts 18 on the weighting plate 12.

Figure 3I:
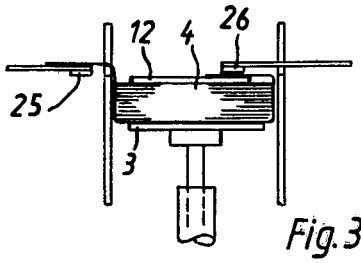

As will be seen in FIG. 3*i*, the welding of a label tape is started by the pusher 26, placed on the right hand side of the table 3, pushing the label tape in firstly on its side over the weighting plate 12 and, for this reason, over the top side of the stack.

Figure 3J:
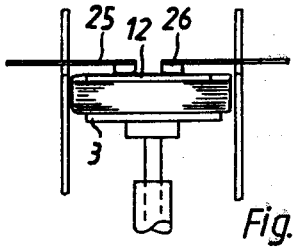

Then, as will be seen from FIG. 3*j*, the pusher 25, placed on the left of the table 3, and which is heated, is moved in the same way over the stack weighting plate 12 so that, in the end, the label tape ends are placed one on top of the other and welded together while being forced against the weighting plate 12.

Figure 3K:
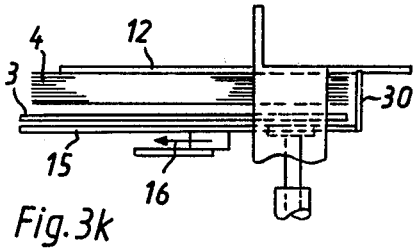
Figure 3L:
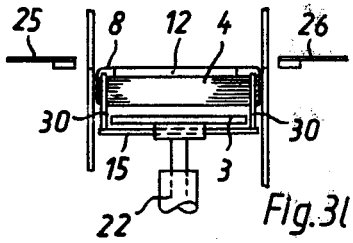
Figure 3M:
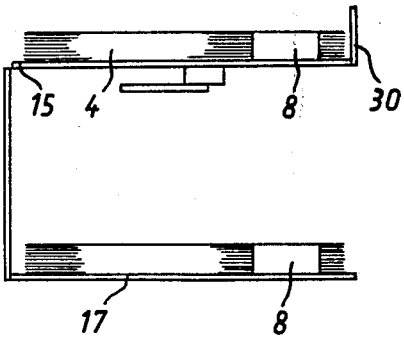
Figure 3M:
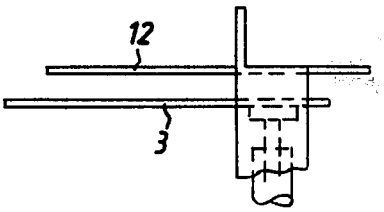

FIGS. 3*k*, 3*l* and 3*m* are lastly views making clear the output of the taped stack from the apparatus. For this purpose the pushers 25 and 26 are pulled back into their starting positions. Furthermore the compressed air is turned off from the air-power cylinder 22 so that the label taping table 3 is lowered and the stack or parcel 4, positioned by the label tape 8, is kept hanging under the weighting plate 12, which, as will be seen, is done up with the stack within the label tape. In the last stage of the operation, the transport table 15, placed under the label taping table 3, is moved in the direction of the arrow 16. In this respect the two driving parts 30, fixed to the transport table 15, are responsible for pushing the parcel from the weighting plate 12 and, for this reason, from the taping table 3, on to the moved-forward transport table 15, which, when it has got into the position to be seen in FIG. 3*m* over the table 17, is moved back sharply so that the parcel, because of its weight, has the tendency of keeping its position and lastly is dropped on to the takeup table 17 placed under it.

After the parts have come back into the stage of the operation to be seen in FIG. 3*a*, a further stacking and taping operation may be started.

As has been noted earlier in the present account, the important conditions for a good and long-lasting seat of the label tape on the banknotes are more specially:

a certain run-in and positioning of the label tape, good forming of the stack of banknotes, that is to say with all sides in line and flat, a strong weld between the ends of the label tape and a tight condition of the tape (for which the welding unit is responsible).

LABEL TAPE RUN-IN UNIT (FIGS. 4*a*, 4*b* and 4*c*)

In these figures the unit for run-in and cutting of the label tape is again made clear in all details, which was to be seen in FIG. 2 together with the apparatus generally.

As said earlier, the label tape run-in unit 13 is responsible for seeing that the label tape after each taping operation, and before the stacking of the first banknote of a stack, is pushed for the necessary length over the taping table and, after the stack has been formed, is cut to the necessary length.

The transport system of the run-in unit 13 is made up of two rubber wheels or rollers 32 and 33, rubbingly touching each other, between which the label tape 8 is guided, the system being turned in the direction of the arrow 34 by the shaft of the driving roller or wheel 32 being joined with a motor. As the reader will see from FIG. 4*a*, the label tape 8 is unrolled from an input roll 36 and run over a guide roller 37 to the rollers 32 and 33. Opposite to the guide roller 37 there is a reflexion photo-electric system 38, sensing line markings on the label tape printed with a certain spacing between them (not to be seen in the figures) so that, because of its being put in a single system with the driving motor, it is responsible for the input of label tape in a forward direction as is necessary.

Coming from the rubber rollers 32 and 33, the label tape 8 is moved through the cutting unit 21, which is to be seen in full detail in FIG. 4*c*. As will be seen from this figure, the cutting unit 21 is made up of a bearing block 41 having guideways 42*a* and 42*b* in the form of slots and having a size dependent on the breadth of the tabel tape 8, and the cutting unit 21 is further made up of the cutter 43 itself, which in the same way in the plane of the label tape transport has a slot-like guideway 44. The cutter 43 is in the form of a threaded rod which, as will be seen from FIG. 4*b*, is screwed into the bearing block 41. The threaded rod is turned with the help of a lever arm 45, joined with an air-powered cylinder (not viewed). The cutting of the label tape 8 guided by the slots 42*a*, 44 and 42*b*, placed one behind the other, is produced because the threaded rod (43) is turned in relation to the bearing block 41 in the direction of arrow 46, in which respect the outlet end of the slot of the threaded rod (43) is moved past the further slot 42*b* of the bearing block 41 so that the label tape is cut. After cutting, the threaded rod is moved back into the starting position so that the guideway 44 goes back into the horizontal position to be seen in FIG. 4*c*.

As the reader will, more specially, be able to see from FIG. 4*c*, the guideways of the cutting unit in the transport direction of the label tape are so designed that any stopping up because of a smash up of the label tape while being guided is not possible.

For this purpose the inlet end of the cutting unit 21 is made funnel-formed to make certain of simple threading in of the label tape. Furthermore the separate guideways going as far as the threaded rod (43) are made greater in cross-section step-by-step so that there will be no stopping of label tape transport because of sticking-out edges. Lastly, the guideway 44 of the threaded rod (43) is so designed that in the transport direction of the label tape it gets narrower and, for this reason, at its outlet position, that is to say at the position of cutting the label tape, it is narrower than the further guideway 42*b* of the bearing block 41. This is to make certain that the end front edge of the cut label tape may be moved on without any running troubles for the next taping operation and that it is only the piece of label tape coming from the threaded rod which is cut off, so that no new threading in of label tape is necessary.

After the cutting unit 21 the label tape 8 goes through a specially contoured guide pipe 40 of a certain length and which is fixed to the cutting unit 21 in the plane of the guideway 42*b* of the bearing block 41. As will be seen, more specially, by the reader on looking at FIG. 4*b*, it will be clear that the guide pipe is specially contoured in a direction normal to the direction of forward motion of the label tape 8 so that the last-named, guided through the space is automatically, or necessarily, curved in a direction normal to the direction of forward motion and, for this reason, is made stiffer in the direction of forward motion. Because of this stiffer form, the label tape 8 is, for this reason, able to be guided in the desired way over the taping table without any mechanical support. For stopping any excessive heating up of the label tape by the heat of the heated pusher 25 in the case of long times of use, between the pusher 25 and the label tape transporting system, sheet metal screens 55 are present.

THE STACKING AND TAPING UNIT (SEE FIGS. 5 AND 6)

The truing up of the stack on all sides is one of the most important conditions for trouble-free and high quality doing up of the parcels of banknotes with label tapes.

The stack truing parts were noted earlier for the first time in part in connection with the account given of FIGS. 1 and 2. The stack truing parts are the support wall 9 at the long-edge of the stack and a truing up part 10 of sheet metal, and at the narrow stack end edges the stripper 11 and the weighting plate 12, which is kept in an upright position while the banknotes are being dropped. For helping with truing up of the edges of the stack, the sheet metal truing up part 10 is best caused to undergo a shaking motion with a frequency the same as the natural frequency of the sheet metal truing up part.

After the dropping of the banknotes for forming the stack into position, the weighting plate 12 is turned in the direction of arrow 20 on to the stack. As the reader will see from FIG. 5, the turning point or fulcrum point 31 of the weighting plate 12 is so placed that the part, which is under the turning point, of the weighting plate is moved, when turning takes place, in a direction from the nearby end side of the stack (position of the weighting plate marked in broken lines). For this reason, the weighting plate 12 may be turned on to the stack 4 without any twisting or skewing of the stack banknotes at the nearby end face of the stack.

Furthermore for truing up the stack further parts of the apparatus are present, that is to say the guide fingers 28 placed on the two sides of the weighting plate 12 on the taping table 3 and the finger-like tailpieces 19 of the side sheet metal parts 18, whose function will now be made clear.

On processing banknotes, which are in a poor condition, it is not possible to make certain that the end edges, near the weighting plate 12, of some banknotes will not be trued up with the rest of the edges in the stack and in fact will be turned upwards or curved upwards so as to be at a greater or lesser distance from the stack. If now the weighting plate, as noted earlier, is turned away from the nearby stack side, while it is true that the bent-up banknote parts, will be dropped or moved down onto the stack again, because they will be slipped downwards against the weighting plate being turned away from them, dependent on the degree to which they are bent, they will be out of line and sticking past the stack edge in question. For putting an end to this, the guide fingers 28, noted earlier, are placed on the two sides of the weighting plate to make certain that the end edges, slipped downwards against the weighting plate when it is turned will have the effect of guiding the bent upwards or curved upwards banknotes against the stack with their edges in line.

The finger-like tailpieces 19, noted earlier, of the sheet metal side guides 18 are designed for helping truing up the long edges of the stack of banknotes. They are, as will be seen from FIGS. 5 and 6, each placed in the cutout 14 of the truing up sheet metal former 10 and in the cutout 39 of the support wall 9 and they come to an end vertically in line with the two inner faces of the side parts, with the truing up sheet metal former 10 and the support wall 9.

The finger-like tailpieces 19 are, for this reason, used as guiding truing up parts of the sheet metal former 10 and the support wall 9 to make certain that all banknotes are positioned with their edges trued up between the sheet metal side parts 18.

If the banknotes in the stack are very much curled because of a poor condition of the banknote paper, the banknotes to the top of the stack are guided by the weighting plate 12, turned on to the stack, with their edges trued up between the finger-like tailpieces 19 and in this case, in some conditions, even before the "pulling down motion" of the "air-cushioned" taping table 3 dependent on the stack height pushing down in the direction of the arrow 47 takes place to a greater or lesser degree, so that the processing of the banknotes with different stack heights is made possible without any trouble.

As a general point, it is to be noted in connection with the stacking and taping unit that it is so designed with its parts designed on the lines of the present invention that even banknotes with paper in a very poor condition are not the cause of any stopping of the sorting operation taking place. Even banknote stacks, which in some cases may have folded or skewed banknotes within them, are in every case so trued up and forced together that taping with a label tape becomes possible. Without being dependent on the quality of the banknotes and, for this reason, on the quality of the stack formed, the taping of the stack is made possible in every case. Making the best use of a sorting and taping operation without any running troubles, the shortcoming is put up with in this respect that banknote stacks whose edges are not true may possibly have to be processed by hand in addition after taping.

THE WELDING UNIT (FIGS. *7a, 7b* AND *7c*)

In FIGS. *7a* to *7c* the last stage of taping is to be seen, that is to say placing the ends of a label tape on the top side of the stack and the welding of the ends together. Furthermore the figures have views of the special design of the pusher 25 and 26 which we have noted earlier, together with their operation together for making certain of tight positioning of the tape ends and of a strong weld join.

The two pushers 25 and 26 are powered by air cylinders (not viewed here). The pusher 26 placed to the right of the taping table 3 is made up of the unheated stamp 49 fixed to a thick leaf spring 51. Over the spring 51 there is furthermore (see FIG. *7c*) a sheet metal guide 54 fixedly positioned, whose function will be made clear further on. The pusher 25, placed to the left of the taping table 3, is used for supporting the heated punch 48, which, unlike the pusher 26, is fixed to two less strong leaf springs 52*a* and 52*b*. In this respect the stamp (or punch) 48 is positioned parallel to its long-axis with the help of a pin 53 in such a way on the leaf springs 52*a* and 52*b* that it may be turned to a certain degree about its long-axis. Furthermore the punch 48, because of the way it is fixed to the leaf springs 52*a* and 52*b*, may be moved elastically in relation to its direction of motion. Furthermore, as the reader will see from FIGS. *7a* to *7c*, the weighting plate 12, which, to make the view clearer, has very thick lines in the figure, is designed sloping towards the sides, so that the two pushers 25 and 26 may be slipped readily on the pushing or weighting plate. While this takes place, the ends of the label tape are placed, one tightly on top of the other, on the weighting plate 12 over the top side of the stack. Because the stack undergoes expansion under its natural elasticity as soon as the force, forcing it together, of the taping table 3, comes to an end, it is not necessary for the ends of the label tape to be placed round the top side of the stack with any pulling force in addition. The important point is that the label tape is placed as tightly as possible against all four sides of the forced-together stack 4.

As will be seen, more specially, from FIGS. *7b* and *7c*, the two leaf springs 52*a* and 52*b*, supporting the heated stamp, are pushed, in the end position of the pusher 25 under the sheet metal guide 54 and in this respect the welding stamp 48 is moved, at the point in time in which welding itself takes place, by the further force of the sheet metal guide 54 with a greater effect and for its full length "a" against the end of the label tape. Because the welding stamp is in addition turningly journaled for turning about its long-axis, it is forced for its complete breadth "b" against the ends of the label tape, so making certain, in the case of every welding operation, that the welding stamp has its full face forced with an increased pressure on to the ends of the label tape; this being responsible for a long-lasting weld-join and a short welding time.

It is to be noted, lastly, that the welding stamp is not heated directly as in the old systems, but indirectly.

As will be seen in this respect from FIG. 7*a*, the welding stamp 48 is first moved up against an electric, unmoving heater 50, in the resting stage of operation. At the time of the welding operation, the welding stamp, made of a material with a high thermal conductivity, only gives up part of its heat so that in the resting stage the amount of heat given up may be made good within a very short time using the unmoving heater 50.

The indirect heating of the welding stamp makes for the useful effect that no electrical connections are needed for the moving parts and furthermore no active parts are needed in the welding part which is being moved all the time and is acted upon by sudden forces and shaking effects.

The separate parts or units of the overall apparatus, such as the welding or label tape input unit may naturally be used with good effect in other connections, as for example in taping units only used for taping in the limited sense, such as those of the table design, with a unit with only a taping function.

We claim:

1. A process for banding a stack of thin material sheets with a sealable tape, said sheets being delivered in seriatim, said method comprising the steps of:

placing a predetermined length of tape on a table constrained for movement only in the direction normal to the face of the stack;

placing the sheets with their faces on the table and one of their edges against a plate adjacent and lying normal to the table to form a stack from the sheets;

placing the plate on top of the stack;

moving the table, stack, and plate in a direction normal to the face of the stack for applying the tape to the stack;

wrapping the tape around the stack and plate with the ends thereof overlapping;

sealing the ends of the tape; and removing the stack from the table and plate.

2. The process according to claim 1 further defined as pivoting the plate from its normal position onto the stack.

3. The process according to claim 2 including the step of cutting a piece of tape from a continuous supply upon the pivoting of the plate onto the stack.

4. Apparatus for banding a stack of thin material sheets with a sealable tape, said apparatus being suitable for use with a sheet transport system delivering the sheets in seriatim, said apparatus comprising:

a stacking table for receiving the sheets from the transport system to form a stack thereon, said table being movable in a direction normal to the face of the stack and being restrained for movement in other directions;

a plate operatively associated with the stacking table and having a first position in which it lies generally normal to said stacking table so that one end of said stack may be formed against said plate, said plate being pivotable to a second position parallel to said table for forcing the stack against said stacking table;

a tape unit for feeding a predetermined length of tape across said stacking table prior to the formation of the stack thereon;

means for wrapping the ends of said tape around the stack and plate;

means for sealing the ends of the tape; and means for removing the stack with the surrounding tape from said stacking table and plate.

5. The apparatus according to claim 4 wherein said plate has a pivot point, said pivot point being located at the same level as the top of a stack of a predetermined number of sheets.

6. The apparatus according to claim 4 wherein said plate is pivoted by a pneumatic cylinder.

7. The apparatus according to claim 4 wherein said stacking table is mounted for resilient movement in a direction normal to the face of the stack.

8. The apparatus according to claim 4 suitable for use with a sheet transport system having a stripping part forming a wall opposite to said plate, said apparatus having a support wall normal to said plate and stacking table against which one side of said stack rests and having a guide wall opposite said support wall against which the other side of the stack rests.

9. The apparatus according to claim 8 wherein said guide wall includes a vibrator means.

10. The apparatus according to claim 9 wherein said guide wall has a resonant frequency and wherein said vibrator means is capable of vibrating said guide wall at its resonant frequency.

11. The apparatus according to claim 8 wherein said apparatus includes guides along the sides of the stack coacting with said support wall and guide wall, said tape unit being adjacent one of said guides for feeding a predetermined length of tape over said table and past the top edges of said guides, said sealing means comprising a heat sealing unit placed adjacent said guides for sealing the ends of said tape.

12. The apparatus according to claim 11 wherein said guides have finger-like tail pieces in the planes of said support wall and guide wall for guiding the sides of the sheets.

13. The apparatus according to claim 4 further including a transport table positioned beneath said stacking table having means engaging the banded stack for removing the stack from said plate for discharge from said apparatus; said stacking table being movable so as to suspend said banded stack from said plate.

14. The apparatus according to claim 13 wherein said stacking table is supported by a pneumatic cylinder resiliently supporting said stacking table and permitting said stacking table to be moved in a direction normal to the face of the stack to suspend the banded stack.

15. The apparatus according to claim 13 wherein said transport table reciprocates beneath said stacking table and wherein said transport table has a slow motion in one direction for clearing the stack from the plate and a rapid motion in the other direction permitting discharge of the banded stack from said apparatus.

16. The apparatus according to claim 13 wherein said transport table has guide fingers lying generally normal to said transport table for engaging the banded stack.

17. The apparatus according to claim 4 wherein said tape unit includes a transport means for an endless tape, a bearing block with a passage for the tape, said bearing block having a cutting roller journalled therein and through which said tape extends; and guide means for feeding the tape over the stacking table 17.

18. The apparatus according to claim 17 wherein said guide means is curved in a direction normal to the tape feed direction.

19. The apparatus according to claim 4 wherein said sealing means includes a pair of arms extendable over the stack and plate into contiguity with each other, one of said arms having a greater flexural stiffness than the other, said less stiff arm having heatable means mounted thereon.

20. The apparatus according to claim 19 wherein said heatable means is heatable by conduction.

21. The apparatus according to claim 19 wherein said heatable means is pivotally mounted on said arm.

22. The apparatus according to claim 19 wherein said less stiff arm includes two parallel leaf springs.

23. The apparatus according to claim 19 wherein the stiffer arm includes a single leaf spring.

24. The apparatus according to claim 19 wherein said arms are so formed that said stiffer arm overlaps said less stiff arm to force the latter against the plate.

* * * * *